US009217190B2

(12) United States Patent
Butler

(10) Patent No.: US 9,217,190 B2
(45) Date of Patent: Dec. 22, 2015

(54) STERLING SILVER ALLOY AND ARTICLES MADE FROM SAME

(75) Inventor: John Robert Butler, Lafayette, LA (US)

(73) Assignee: Stuller, Inc., Lafayette, LA (US)

( * ) Notice: Subject to any disclaimer, the term of this patent is extended or adjusted under 35 U.S.C. 154(b) by 1027 days.

(21) Appl. No.: 13/224,116

(22) Filed: Sep. 1, 2011

(65) Prior Publication Data

US 2013/0112322 A1 May 9, 2013

(51) Int. Cl.

| | |
|---|---|
| ***C22C 5/08*** | (2006.01) |
| ***A44C 27/00*** | (2006.01) |
| ***C22C 5/06*** | (2006.01) |
| ***C22F 1/14*** | (2006.01) |

(52) U.S. Cl.

CPC ..... *C22C 5/08* (2013.01); *A44C 27/003* (2013.01); *C22C 5/06* (2013.01); *C22F 1/14* (2013.01)

(58) Field of Classification Search

CPC ..... A44C 27/003; C22F 1/14; C22C 5/06; C22C 5/08

USPC ..... 420/503, 504; 148/430

See application file for complete search history.

(56) References Cited

U.S. PATENT DOCUMENTS

| | | | |
|---|---|---|---|
| 1,590,091 | A | 6/1926 | Heusler |
| 1,614,752 | A | 1/1927 | Mitchell |
| 1,628,673 | A | 5/1927 | Leach |
| 1,643,304 | A | 9/1927 | Korsunsky |
| 1,720,894 | A | 7/1929 | Gray et al. |
| 1,863,612 | A | 6/1932 | Assmann |
| 1,863,645 | A | 6/1932 | Assmann |
| 1,888,188 | A | 11/1932 | Tanabe |
| 1,896,410 | A | 2/1933 | Leach |
| 1,913,423 | A | 6/1933 | Wise |
| 1,970,318 | A | 8/1934 | Kern |
| 1,970,319 | A | 8/1934 | Kern |
| 1,984,225 | A | 12/1934 | McFarland |
| 2,031,113 | A | 2/1936 | Leach |
| 2,052,142 | A | 8/1936 | Kern |
| 2,052,143 | A | 8/1936 | Kern |
| 2,196,302 | A | 4/1940 | Hensel et al. |
| 2,196,306 | A | 4/1940 | Hensel et al. |
| 2,196,307 | A | 4/1940 | Hensel et al. |
| 2,221,285 | A | 11/1940 | Hensel et al. |
| 2,719,085 | A | 9/1955 | Schatz |
| 2,772,156 | A | 11/1956 | Primose |
| 3,778,259 | A | 12/1973 | Viglione |
| 3,811,876 | A | 5/1974 | Harigaya et al. |
| 4,124,380 | A | 11/1978 | Youdelis |
| 4,659,378 | A | 4/1987 | Volz et al. |
| 4,775,511 | A | 10/1988 | Kono et al. |
| 4,810,308 | A | 3/1989 | Eagar et al. |
| 4,869,757 | A | 9/1989 | Eagar et al. |
| 4,973,446 | A | 11/1990 | Bernhard et al. |
| 5,037,708 | A | 8/1991 | Davitz |
| 5,039,479 | A | 8/1991 | Bernhard et al. |
| 5,171,643 | A | 12/1992 | Suzuki et al. |
| 5,558,833 | A | 9/1996 | Zamojski |
| 5,817,195 | A | 10/1998 | Davitz |
| 5,882,441 | A | 3/1999 | Davitz |
| 5,919,320 | A | 7/1999 | Agarwal et al. |
| 6,139,652 | A | 10/2000 | Carrano et al. |
| 6,168,071 | B1 | 1/2001 | Johns |
| 6,406,664 | B1 | 6/2002 | Diamond |
| 6,726,877 | B1 | 4/2004 | Eccles |
| 6,841,012 | B2 | 1/2005 | Croce |
| 6,860,949 | B1 | 3/2005 | Weber |
| 7,118,707 | B2 | 10/2006 | Robinson |
| 7,128,792 | B2 | 10/2006 | Menon |
| 7,128,871 | B2 | 10/2006 | Davitz |
| 7,198,683 | B2 | 4/2007 | Agarwal et al. |
| 8,136,370 | B2 | 3/2012 | Bennett |
| 8,771,591 | B1 | 7/2014 | Bennett |
| 2007/0251610 | A1 | 11/2007 | Johns |

(Continued)

FOREIGN PATENT DOCUMENTS

| | | |
|---|---|---|
| DE | 4213897 | 5/1992 |
| GB | 2255348 A | 4/1992 |

(Continued)

OTHER PUBLICATIONS

Davis et al., "Precious Metals and Alloys", Metals Handbook Desk Edition, 1998, ASM International, p. 1-25.*

Pitwonka, Thomas S., "Molding Methods—Investment Casting", 1998, Metals Handbook, 2nd Edition, ASM International, p. 1-13.

Michael T. Roche and Frank E. Goodwin, Improved Tarnish Resistant Sterling Silver, Sep. 2003, Silver Research Consortium, Durham, NC USA.

*Primary Examiner* — Roy King
*Assistant Examiner* — Caitlin Kiechle
(74) *Attorney, Agent, or Firm* — Roy Kiesel Ford Doody & Thurmon

(57) ABSTRACT

An improved sterling silver alloy. Like all sterlings, the improved alloy is at least 92.5 percent silver by weight. It has less copper than traditional sterlings: 3.0 percent versus the traditional 7.5 percent. Additionally, the improved alloy includes about 2.75 percent palladium, about 1.0 percent tin, and about 0.75 percent zinc, all by weight. A grain refiner, such as ruthenium, may also be provided. The components of the preferred alloy are melted, degassed, remelted, and then formed into casting grains, wire, and etc. The resulting alloy is significantly harder, as cast, than traditional sterlings: 95-120 Vickers versus 65 Vickers for traditional sterlings. The improved alloy also exhibits improved corrosion resistance. Other than a slightly higher (<200° F.) liquidus temperature, the improved alloy may be worked in substantially the same manner as traditional sterlings. Pieces cast from the improved alloy may be age hardened to about 160 Vickers, if desired.

30 Claims, 5 Drawing Sheets

(56) References Cited

U.S. PATENT DOCUMENTS

| | | | |
|---|---|---|---|
| 2008/0069722 | A1 | 3/2008 | Johns |
| 2009/0205369 | A1 | 8/2009 | Bennett |
| 2010/0263769 | A1 | 10/2010 | Johns |
| 2014/0003992 | A1 | 1/2014 | Fogel |

FOREIGN PATENT DOCUMENTS

| | | | |
|---|---|---|---|
| GB | 2438198 | A | 11/2007 |
| WO | WO95/14112 | | 5/1995 |
| WO | WO96/22400 | | 7/1996 |
| WO | 9803688 | A1 | 1/1998 |

* cited by examiner

Composition of Preferred Alloy

| Component | Acceptable Range* | Preferred Percentage* |
|---|---|---|
| Silver | 92.5 % (minimum) + | 92.7% |
| Copper | 2.0 to 3.7 % | 2.8 % |
| Palladium | 2.5 to 3.3 % | 2.75 % |
| Tin | 0.5 to 1.25 % | 1.0 % |
| Zinc | 0.5 to 1.25 % | 0.75 % |
| Grain Refiner | 0 to 0.01% | 0.005% |

* All percentages are by weight

Figure 1

**CIE LAB L* Values of Sprues as Cast**

| Rings | Traditional Sterling | Improved Alloy |
|---|---|---|
| TS1, IA1 | 41.70 | 60.23 |
| TS2, IA2 | 39.95 | 57.63 |
| TS3, IA3 | 40.18 | 61.39 |
| TS4, IA4 | 40.02 | 60.95 |
| TS5, IA5 | 43.36 | 61.40 |
| Averages | 40.95 | 60.32 |

Figure 2

Corrosion Testing

| | Imp. Alloy | | Traditional Sterling | | Alloy A | | Alloy B | | Alloy C | | Alloy D | | Alloy E | |
|---|---|---|---|---|---|---|---|---|---|---|---|---|---|---|
| | 0 | +96h | 0 | +96h | 0 | +96h | 0 | +96h | 0 | +96h | 0 | +96h | 0 | +96h |
| L* | 94.63 | 93.75 | 91.44 | 86.14 | 92.8 | 88.02 | 94.37 | 93.69 | 90.14 | 90.78 | 95.01 | 94.27 | 93.49 | 93.63 |
| a* | - 0.24 | - 0.15 | -1.1 | -1.06 | -0.91 | -1.43 | -0.55 | -0.74 | 0.76 | 0.62 | -0.8 | -0.71 | 0.19 | -0.24 |
| b* | 4.69 | 4.93 | 6.9 | 8.97 | 8.59 | 11.32 | 5.44 | 6.25 | 6.99 | 6.98 | 5.42 | 5.49 | 5.03 | 5.95 |
| Y ID | 8.8 | 9.39 | 12.57 | 17.26 | 15.67 | 21.02 | 9.99 | 11.4 | 14.4 | 14.2 | 9.7 | 9.97 | 9.88 | 11.24 |
| Vickers Hardness (As Cast) | 97 | | 68 | | 68 | | 54 | | 65 | | 70 | | 70 | |

Figure 3

STERLING SILVER ALLOY AND ARTICLES MADE FROM SAME

BACKGROUND OF THE INVENTION

1. Field of the Invention

The invention relates to sterling silver in general and hardened, corrosion resistant sterling silver in particular.

2. Prior Art

Sterling silver is, by definition, a silver alloy that comprises at least 92.5 percent silver, by weight. The remaining 7.5 percent of the alloy is often comprised of copper, but can be any variety of combinations of metals, resulting in sterlings with varied characteristics. However, one common characteristic of sterlings is that they are generally soft.

Sterlings commonly have a Vickers Scale hardness of about 65-75, "as cast." Sterling pieces are often cast in gypsum molds. As soon as the mold has cooled enough for the investment to have solidified, the entire mold will be submerged in water, causing the mold to shatter, thereby releasing the cast piece. This will anneal the cast sterling, making it softer. Nonetheless, the inventor believes that such pieces will have an annealed hardness value close to 65-75 on the Vickers Scale, such that the as cast hardness and the annealed hardness will be comparable for many prior art sterlings. In any event, the term "as cast," as used herein, is intended to encompass investment that is released from its mold by submerging the same into a water bath, while hot.

Depending upon the intended application, the relative softness of most sterlings may or may not be a drawback. However, in many jewelry applications, softness is a decided liability. Sterling silver is generally not used in the setting of precious stones because of the risk that the sterling may bend and the stone lost. Hinges, clasps, earring pins and chains are also typically not made of sterling because of its relative softness. Likewise, the softness of sterling can result in scratches in the finish of high wear items such as rings and bracelets.

Sterling silver can be buffed to a high shine. However, because of its softness, mechanical buffing can mar the finish of traditional sterlings.

Two common ways of increasing the hardness of many metals, including sterling silver, are work hardening and age hardening. Work hardening involves physically working the piece (i.e., bending it, rolling it, drawing it, etc.). Work hardening is generally not appropriate for most pieces that have been cast, as it would change the appearance of the pieces.

Age hardening involves heating the piece. It is suitable for use with cast pieces as they may be heated after casting is complete. However, age hardening has an obvious drawback in that it will increase the cost of manufacturing the piece.

An advantage of traditional sterlings is that they typically are capable of taking a highly lustrous white finish. However, a corresponding disadvantage is that traditional sterlings are quite susceptible to corrosion or tarnishing. Thus, to maintain the highly lustrous finish desired in most sterling pieces, frequent polishing is usually necessary, if the piece is used at all.

In view of the foregoing shortcomings in the prior art, an improved sterling silver alloy is desired meeting one or more of the following objectives.

OBJECTS OF THE INVENTION

It is an object of the invention to provide a sterling silver alloy that is substantially harder, as cast, than traditional sterling silver alloys.

It is a further object of the invention to provide a sterling silver alloy that has an as cast hardness on the Vicker's Scale of at least about 95.

It is a still further object of the invention to provide a sterling silver alloy that is sufficiently hard to be used as a setting for a stone.

It is yet another object of the invention to provide a sterling silver alloy that is sufficiently hard to be used as a clasp.

It is still another object of the invention to provide a sterling silver alloy that is sufficiently hard to be used as a hinge.

It is yet another object of the invention to provide a sterling silver alloy that is resistant to corrosion and tarnishing.

SUMMARY OF THE INVENTION

The invention comprises an improved sterling silver alloy. Like all sterlings, the improved alloy is at least 92.5 percent silver by weight. It has a reduced copper content compared to traditional sterlings: 2.8 to 3.0 percent versus the traditional 7.5 percent. In addition, the improved alloy includes about 2.75 percent palladium, about 1.0 percent tin, and about 0.75 percent zinc, all by weight. A grain refiner, such as ruthenium, may also be provided. When used, the ruthenium will make up about 0.005 percent, by weight, of the alloy. The components of the preferred alloy are preferably melted, degassed, remelted, and then formed into casting grains, wire, and etc. The improved alloy is significantly harder, as cast, than traditional sterlings: 95-120 Vickers versus 65 Vickers for traditional sterlings. The improved alloy also exhibits improved corrosion resistance.

Other than a slightly higher (<200° F.) liquidus temperature, the improved alloy may be worked in substantially the same manner as traditional sterlings, though it may be put to more uses in view of the improved alloy's greater relative hardness. Pieces made from the preferred alloy may be age hardened if desired.

BRIEF DESCRIPTION OF THE DRAWINGS

FIG. 1 is a table giving the preferred composition of the alloy.

FIG. 2 is a table providing comparative CIE LAB L* values of pieces as cast from the preferred composition of the alloy and traditional sterling.

FIG. 3 is a table providing comparative CIE LAB, Yellowness Index, and hardness values for samples cast from the preferred composition of the alloy, traditional sterling, and five commercially available corrosion resistant sterlings prior to and after exposures to Tuccillo-Nielsen solution.

DETAILED DISCLOSURE OF THE INVENTION

Figure 4A:
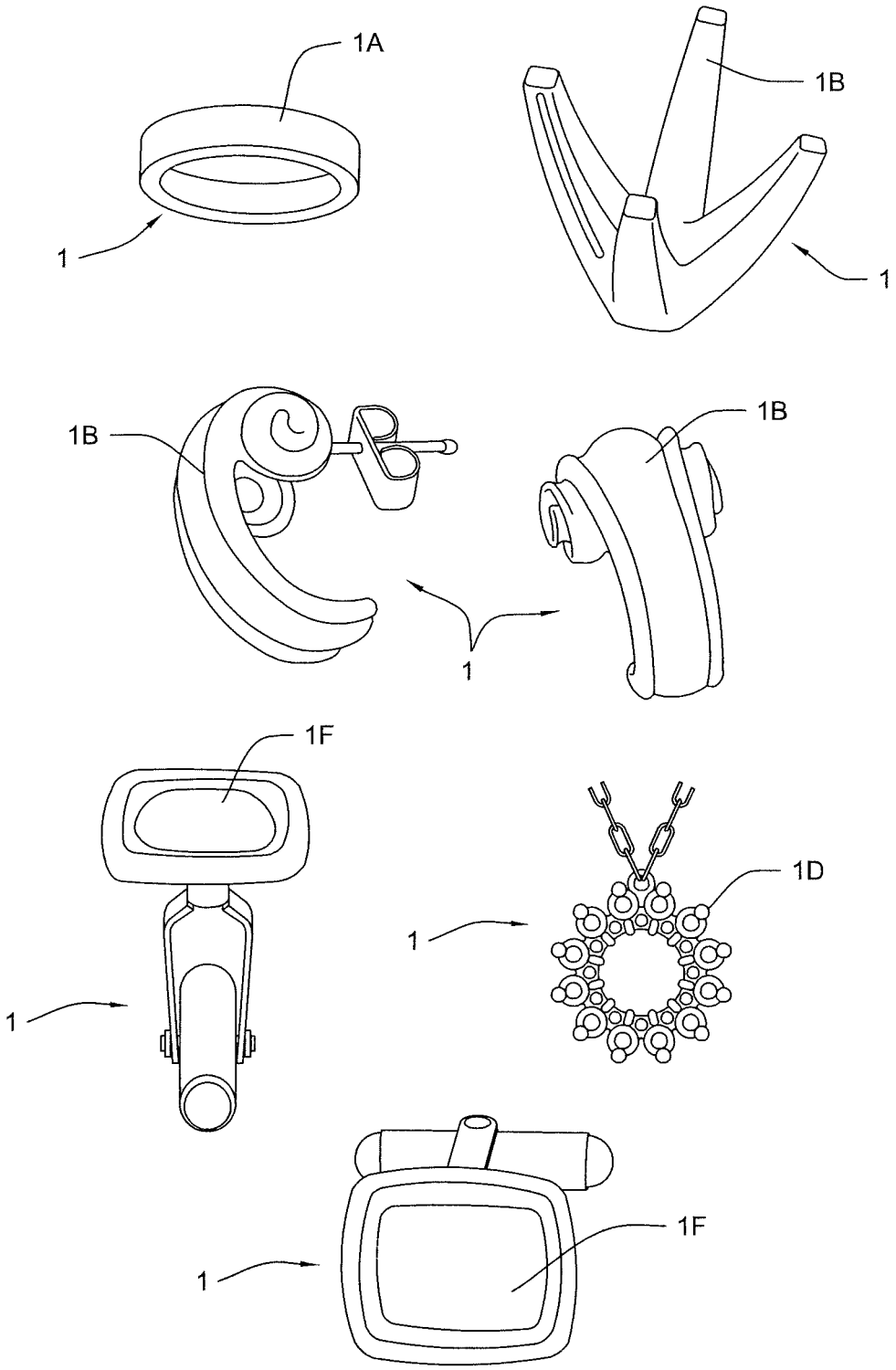
FIG. 4A-4C illustrate some preferred articles for which the alloy may be used.
Figure 4B:
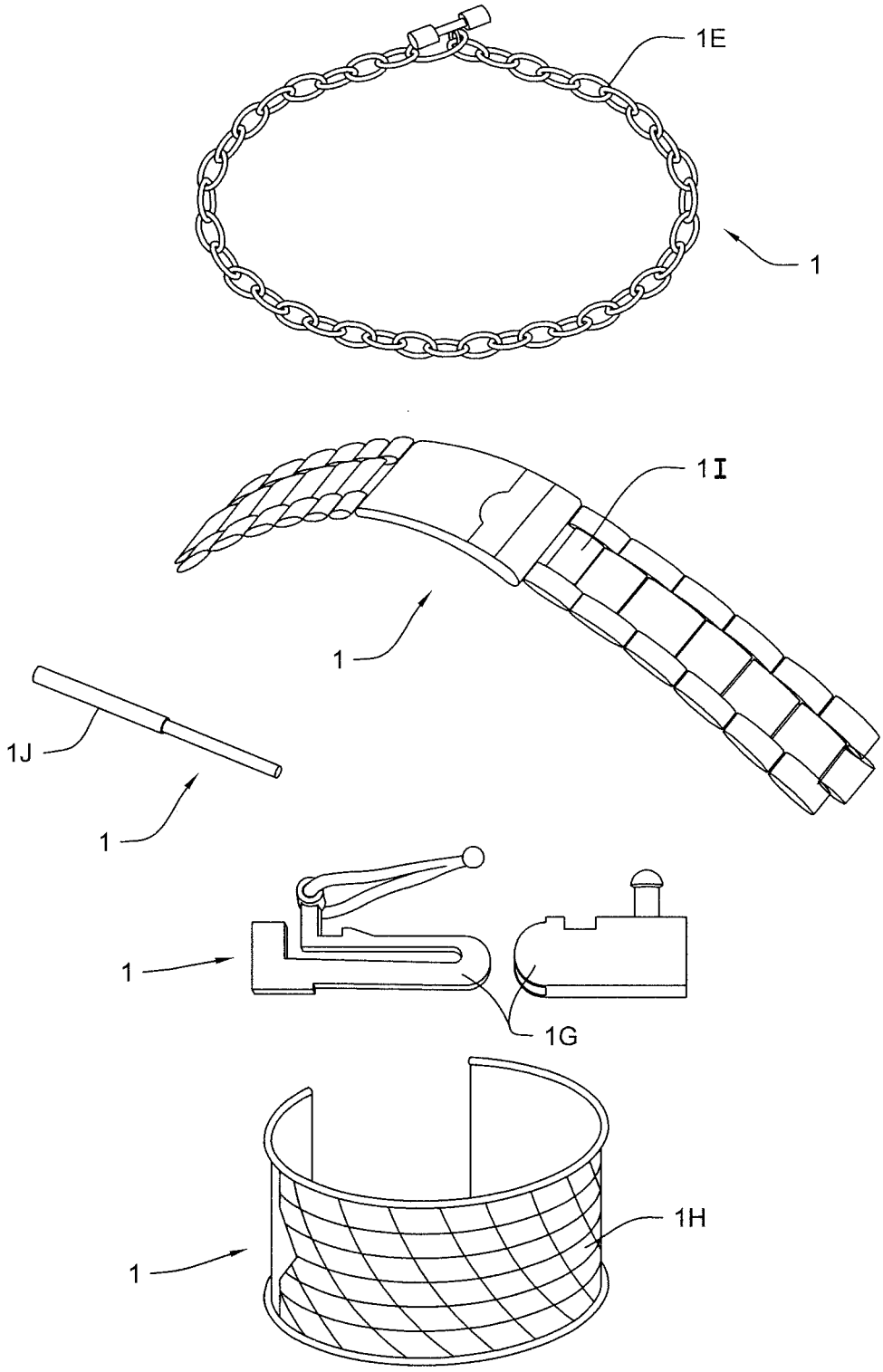
Figure 4C:
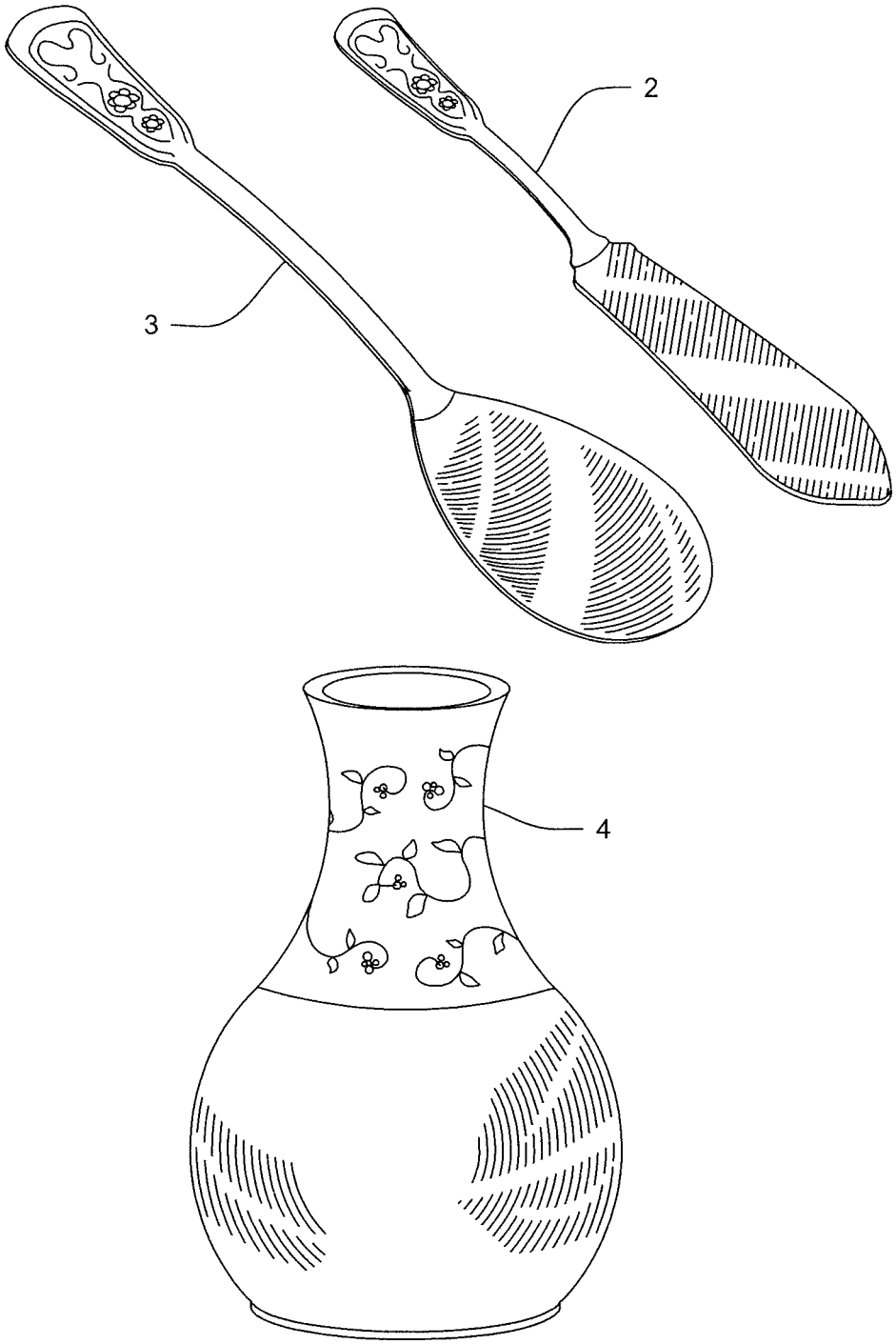

An improved sterling silver alloy is disclosed. The alloy is suitable for making jewelry pieces 1 such as rings 1A, earrings 1B, settings 1C, pendants 1D, chains 1E, cuff-links 1F, clasps 1G, bracelets 1H, as well as flatware 2, serving pieces 3, vases 4, and the like. It is particularly suited for use in pieces which require harder materials than is typically provided in traditional sterling. The alloy also offers superior corrosion resistance as compared to traditional sterling.

The preferred alloy is formed by combining silver (Ag), copper (Cu), palladium (Pd), tin (Sn), and zinc (Zn). Ruthenium (Ru) is preferably added as a grain refiner. The alloy is necessarily at least 92.5 percent silver (Ag), by weight, as it must be to qualify as sterling silver. Furthermore, because sterling articles sold in Europe must often be assayed to ensure that it is at least 92.5 percent silver, with failure of the assay resulting in exclusion of the article, it can be prudent to increase the silver content of sterling alloys slightly above the 92.5 percent floor. Thus, particularly for alloys intended to be sold in Europe, it may be preferable for the alloy to comprise at least 92.7 percent silver by weight.

Pure silver is too soft for most jewelry applications. Copper (Cu) is preferably provided to increase the hardness of the silver while maintaining ductility. The preferred copper concentration in the alloy is between about 2.0 and 3.7 percent by weight, most preferably 2.8 to 3.0 percent by weight. This can be contrasted with most traditional sterlings in which the copper concentration is closer to 6 or 7 percent by weight.

In classic sterling silver, copper makes up 7.5 percent of the alloy, by weight. However, copper is susceptible to tarnishing via the formation of sulphides. Pure silver can tarnish as well, but the presence of copper in traditional sterling silver makes most sterlings much more susceptible to tarnish.

In the preferred alloy, a substantial portion of the copper is replaced with palladium (Pd). Under normal atmospheric conditions, palladium is very resistant to corrosion. Thus, the presence of palladium in the alloy will help prevent tarnishing. Additionally, unlike copper, palladium has a color that is comparable to that of silver. Palladium is also harder than pure silver. The preferred palladium concentration in the alloy is between about 2.5 percent and about 3.3 percent, by weight, and most preferably about 2.75 percent, by weight.

Tin (Sn) is also added to the preferred alloy. Tin is added to increase the hardness of the alloy and also to inhibit corrosion. Tin preferably makes up between about 0.5 and about 1.25 percent of the alloy, by weight, and most preferably comprises about 1.0 percent, by weight.

Zinc (Zn) is preferably provided to increase the corrosion resistance of the alloy. Zinc will also help lower the melting point of the finished alloy. The preferred zinc concentration in the alloy is between about 0.50 and 1.25 percent by weight, most preferably about 0.75 percent by weight.

Ruthenium (Ru) may be added to the alloy as a grain refiner. This can help avoid the formation of large grains in the finished product, which can be unsightly in jewelry applications. When used, ruthenium preferably comprises up to about 0.01 percent and most preferably about 0.005 percent of the alloy, by weight. Additional ruthenium could be used if convenient; however, the ranges described above are expected to provide all needed grain refinement.

The alloy is preferably made by admixing shot of the components listed in and in the proportions provided in FIG. 1. A desired amount of the shot mixture is then poured into a crucible where it is heated, preferably via induction, to about 1850 degrees F. for four minutes.

Heating is preferably performed in an inert atmosphere, such as argon (Ar), to avoid tarnishing the components. Heating the mixture to this temperature will melt all of the components except palladium. However, at the stated temperature and given the relative amount of palladium, all of the palladium will dissolve into the molten solution. Thus, four minutes at 1850 degrees will yield a fully liquid metal solution. This solution is then allowed to solidify in order to degass the alloy, which will minimize internal porosity. The alloy is remelted in the crucible and then formed into casting grains, ingots, wire, or other desired bulk form. Alternatively, the molten alloy could be poured directly into an investment casting for jewelry fabrication.

The preferred alloy of the present invention will have a liquidus point of about 1790 degrees F. This compares to the liquidus of traditional sterling of about 1650 degrees F.

The preferred alloy of the present invention will have an as cast hardness between about 95 and 120 on the Vickers scale. Alloys of this hardness are suitable for use as stone settings, earring posts, hinges, laches, clasps, chain and wire. Pieces made with alloys of this hardness may also be polished mechanically without marring their finish.

The preferred alloy may be age hardened. This is preferably done by annealing the cast piece to about 1200 degrees F. The length of time to maintain the piece at the annealing temperature will vary depending upon the size of the piece, but for ring sized pieces, five to ten minutes has been found to be sufficient. The inventor typically age hardens in an inert atmosphere, such as argon or hydrogen (wherein the hydrogen acts as an oxygen scavenger); however, that is not believed to be necessary for this alloy because of its corrosion resistance. After heating for the requisite amount of time, the piece will be quenched in water upon removal from the oven. It will then be dried and returned to an oven where it is heated to 800 degrees F. for about thirty-five minutes, typically in atmospheric conditions. The piece will then be allowed to air cool to room temperature, and then buffed to restore the finish. Age hardening in this fashion will increase hardness to about 160 on the Vickers scale. In addition, the spring strength of the metal will be substantially enhanced. Age hardening will make the alloy more suitable for use as a watch pin, a clasp or other spring, and as a setting. The corrosion resistance of the alloy facilitates age hardening, in that the piece will not be as likely to tarnish, a particularly valuable characteristic when hardening takes place in a non-inert atmosphere. As compared to other age hardenable sterlings, less post-hardening work will be required to restore the finish of the piece.

The alloy of the present invention may be worked in substantially the same manner as traditional sterling. By way of example, once casting grains are formed, the grains may be melted in a crucible in the same manner as traditional sterling, though a slightly higher temperature must be reached to achieve liquidus. (at least 1790° F., and preferably 1850° F. to ensure a complete melt) The molten alloy may be poured into investment molds (typically gypsum). The mold will contain one or more cavities having the shape of the desired jewelry article, piece of flatware, etc. Once the investment has hardened, the entire mold may be submerged in water to shatter the mold and release the investment.

The investment should preferably be about 800 degrees F. before it is quenched. Delays of about fifteen minutes between pouring and quenching are usually sufficient. This is a relatively short delay, and a relatively high temperature for quenching, as compared to other commercially available corrosion resistant sterlings. These sterlings are prone to cracking if not allowed to cool for at least about thirty minutes. Although the present alloy is not as prone to cracking, it should be noted that immersion in water while the piece is still at about 800 degrees F. will anneal the alloy to some degree. Greater as cast hardness should be achievable by allowing the investment to cool longer prior to quenching.

Once quenched, the cast pieces may then be removed and polished—mechanically if desired—to yield a finished piece of jewelry 1, flatware 2, serving piece 3, vase 4, and etc. or a component of any of the foregoing. The finished piece may be age hardened, if desired.

The preferred alloy of the present invention is much less susceptible to tarnishing than traditional sterlings. It also compares favorably to other "tarnish resistant" sterlings currently available in the market, as the examples below illustrate.

Corrosion or tarnishing is largely a visual phenomenon. Silver that is tarnished has a strikingly different appearance than silver that is not tarnished. In an attempt to quantify the resistance of the present alloy to tarnishing, CIE LAB and Yellowness Index analyses were performed.

LAB is an approach to color that attempts to quantify how humans see color. It has three basic coordinates: L* which measures lightness; a* for green/red and b* for blue/yellow. To put the foregoing in context, white is 100 on the CIE LAB L* coordinate and black is zero. On the a* coordinate, a positive value indicates the presence of red and a negative value indicates the presence of green, where 100 equals pure red and −100 equals pure green. On the b* coordinate, a positive value indicates the presence of yellow and a negative value indicates blue, where 100 equals pure yellow and −100 equals pure blue. Generally speaking, a* and b* values relatively near zero are desirable if the metal is to appear white.

A few examples will provide further context: Pure silver has an L* value of about 96, an a* value of about −0.6 and a b* value of about 3.6. Traditional sterling (92.5% Ag, 7.5% Cu) has an L* value of about 94, an a* value of about −0.9, and a b* value of about 5.7.

Another test commonly used in jewelry is the Yellowness Index (YI). This index is commonly used with white gold. For example, alloys that have a YI score above 32 are not considered white gold. Although technically considered white gold, alloys not scoring about 19 or below will typically require some type of surface treatment, such as rhodium plating, to be used in jewelry. Silver alloys scoring above about 19 on the Yellowness Index will, likewise, be too yellow for many jewelry applications.

EXAMPLE 1

Two substantially identical sprues or "trees" were formed of wax, each sprue containing five wax rings. Two investment molds were formed by pouring gypsum around each sprue and allowing the gypsum to harden. The molds were then heated to melt the wax and it was removed to leave to gypsum investment molds. Molten sterling having the formulation listed as the preferred embodiment in FIG. 1 was poured into the first mold. Molten traditional sterling (92.5% Ag; 7.5% Cu) was poured into the second mold. After the molten metal solidified, but while still quite hot (about 15 minutes after pouring), the molds were separately submerged in water. The submersion caused the molds to shatter and freed the two sprues of cast sterling substantially identical in form to the original wax sprues. Each sprue was pressure washed with water at approximately 3000 p.s.i for approximately one to two minutes to remove the remaining gypsum. Each sprue was then dried. The traditional sterling sprue was a dark gray while the sprue made according to the preferred embodiment was a dull white. CTE LAB testing was then performed on each of the ten unpolished rings. L* values are reported in FIG. 2. CIE LAB a*, b*, and Yellowness Index values were taken as well, but they are not reported. The traditional sterling was so dark, as cast, (L* values below 50) that the a*, b* and Yellowness Index values were essentially meaningless.

The traditional sterling rings had an average L* value of 40.95 whereas the rings from the sprue made with the alloy of FIG. 1 had an L* value of 60.32. As noted above, white is 100 on the CIE LAB L* coordinate and black is zero. Thus, as cast, rings made according to the present invention were 50 percent brighter or more white than rings made of traditional sterling. Of course, both may be polished to comparable levels of brightness. However, it is no small advantage that, after casting, the ring made with the improved sterling alloy will require much less polishing as compared to a ring cast with traditional sterling, to achieve a desired degree of brightness.

Comparable results are expected to obtain in pieces worked with heat after casting. Subjecting traditional sterling silver to the heat of a torch will commonly cause tarnishing similar to that experienced in casting. A bench jeweler doing torch work on a piece made from the improved alloy can expect to do much less work to restore the finish of the piece as compared to the amount of work required to restore the finish on a comparable piece made of traditional sterling because of the improved alloy's ability to resist tarnishing. Likewise, for a jeweler age hardening a piece made of the preferred alloy versus a piece made of traditional sterling.

EXAMPLE 2

Tuccillo-Nielsen tarnish testing was conducted on the improved alloy as compared to traditional sterling silver (92.5% Ag, 7.5% Cu) and five commercially available corrosion resistant sterling alloys. The first, Argentium® 935 Original (Alloy A), a commercial alloy available from Argentium International, Ltd. of London (UK) was tested using a Fischer SDD x-ray fluorescence spectrometer and found to have the following composition: 92.7 percent Ag; 5.5 percent Cu; and 1.8 percent Ge. The second, STAGCG-D (Alloy B), a commercial alloy available from United Precious Metal Refining, Inc., of Alden, N.J. (US), was also tested using a Fischer SDD x-ray fluorescence spectrometer and found to have the following composition: 92.7 percent Ag; 2.44 percent Cu; 4.25 percent Zn; and 048. percent Sn. Additionally, trace components (less than 0.1 percent) of Indium (In), Silicon (Si) and Boron (B) were detected. The third, Silvadium®, (Alloy C), a commercial alloy available from United Precious Metal Refining, Inc. was also tested using a Fischer SDD x-ray fluorescence spectrometer and found to have the following composition: 93 percent Ag; 6 percent Pd; and 1.0 percent In. The fourth, Sterling Super™, (UPM STAGCSU, Alloy D), a commercial alloy available from United Precious Metal Refining, Inc. was also tested using a Fischer SDD x-ray fluorescence spectrometer and found to have the following composition: 92.5 percent Ag; 4.25 percent Cu; 2.25 percent Zn; 0.5 percent Pd; 0.25 percent Sn; and 0.25 percent In. The fifth, Elite Silver™, (950-3P, Alloy E), a commercial alloy available from ABI Precious Metals of Carson, Calif., was also tested using a Fischer SDD x-ray fluorescence spectrometer and found to have the following composition: 95 percent Ag; 1.8 percent Zn; 1.0 percent Pd; 0.75 percent In; 0.5 percent Gold (Au); 0.5 percent Cu; 0.25 percent Gallium (Ga); and 0.2 percent Sn. All percentages above are by weight. The improved alloy had the formulation listed as the preferred embodiment in FIG. 1.

Circular blanks were formed from each alloy. They were polished and then initial CIE LAB and Yellowness Index (Y ID1925 C/2°) measurements were taken of all of the blanks. The blanks were then covered with a dry sheet of KimWipes® tissue (Kimberly-Clarke), an additive free tissue made from virgin wood pulp. Using a dropper, the sheet was wetted with a Tuccillo-Nielsen solution (10 percent NaCl, 10 percent acetic acid, balance deionized water, pH 2.12). A quantity of Tuccillo-Nielsen solution sufficient to saturate the KimWipes® sheet in the region immediately over each blank was provided. The saturated KimWipes® sheet was left in place for 24 hours, during which time it substantially dried. The dried KimWipes® sheet was then removed from the blanks, and a fresh KimWipes® sheet was placed over the blanks and the process described above was repeated four times. Measurements reported herein are those taken prior to exposure to the Tuccillo-Nelson solution and after 96 hours of exposure to the solution.

In addition, Vickers hardness was measured on pieces cast from all of the alloys considered. Identical pieces were cast in gypsum, allowed to cool for fifteen minutes and then quenched in ambient water. An "as cast" hardness was measured for each piece. The samples were placed into a metallurgical mount and polished with 180-800 grit silicon carbide paper to provide a uniform measuring surface. The polished samples were tested using the Suntech model M-400-H micro-hardness tester, equipped with a 136° diamond pyramid stylus. A 300 gram load was used.

Corrosion resistance and hardness results are provided in FIGS. 3. As indicated, the improved alloy blank remained substantially unblemished. The improved alloy substantially outperformed traditional sterling in terms of corrosion resistance and yielded either superior or comparable corrosion resistance versus all of the other corrosion resistant sterlings. However, unlike all of the other tested alloys, the improved sterling was able to provide the desired corrosion resistance at much higher hardness levels. The improved alloy was about 39 to 80 percent harder than the other corrosion resistant sterlings.

Although the invention has been described in terms of its preferred embodiments, other embodiments will be apparent to those of skill in the art from a review of the foregoing. Those embodiments as well as the preferred embodiments are intended to be encompassed by the scope and spirit of the following claims.

I claim:

1. A sterling silver alloy comprising:
a. at least 92.5 percent, by weight, silver;
b. about 3.0 percent, by weight, copper;
c. between about 2.75 and about 2.80 percent by weight palladium;
d. about 1.0 percent, by weight, tin; and
e. about 0.75 percent, by weight, zinc.

2. A sterling silver alloy according to claim 1 further comprising ruthenium.

3. A sterling silver alloy according to claim 2 wherein said ruthenium comprises about 0.005 percent by weight of said alloy.

4. A sterling silver alloy according to claim 1 wherein said alloy has an as cast hardness of a least about 95 on the Vickers scale.

5. A sterling silver alloy according to claim 4 wherein said alloy is susceptible to age hardening.

6. A sterling silver alloy according to claim 5 wherein said alloy is age hardenable to about 160 on the Vickers scale.

7. A sterling silver alloy according to claim 1 wherein said alloy has an as cast hardness between about 95 and about 120 on the Vickers scale.

8. A sterling silver alloy according to claim 1 wherein said sterling silver alloy, as cast, has a CIE LAB L* value of at least about 60.

9. A sterling silver alloy according to claim 1 wherein said alloy, having been polished, will maintain a CIE LAB L* value of at least about 90 after 96 hours exposure to an acetic acid solution containing ten percent sodium chloride and having a pH of 2.1.

10. A sterling silver alloy according to claim 9 wherein said alloy has an as cast hardness of a least about 95 on the Vickers scale.

11. A sterling silver alloy according to claim 9 wherein said alloy has an as cast hardness between about 95 and about 120 on the Vickers scale.

12. A sterling silver alloy consisting essentially of:
a. at least about 92.5 percent, by weight, silver;
b. about 2.8 percent, by weight, copper;
c. between about 2.75 and about 2.80 percent by weight palladium;
d. about 1.0 percent, by weight, tin; and
e. about 0.75 percent, by weight, zinc.

13. A sterling silver alloy according to claim 12 further consisting essentially of ruthenium.

14. A sterling silver alloy according to claim 13 wherein said ruthenium is about 0.005 percent by weight of said alloy.

15. An improved sterling silver alloy according to claim 12 wherein said alloy has an as cast hardness of a least about 95 on the Vickers scale.

16. A sterling silver alloy according to claim 15 wherein said alloy is susceptible to age hardening.

17. A sterling silver alloy according to claim 16 wherein said alloy is age hardenable to about 160 on the Vickers scale.

18. A sterling silver according to claim 12 wherein said sterling silver alloy, as cast, has a CIE LAB L* value of at least about 60.

19. A sterling silver according to claim 12 wherein said alloy, having been polished, will maintain a CIE LAB L* value of at least about 90 after 96 hours exposure to an acetic acid solution containing ten percent sodium chloride and having a pH of 2.1.

20. A sterling silver alloy according to claim 19 wherein said alloy has an as cast hardness of a least about 95 on the Vickers scale.

21. A method of making one or more jewelry articles comprising:
placing a casting grains of an alloy in a crucible, wherein said alloy comprises
at least 92.5 percent, by weight, silver;
about 3.0 percent, by weight, copper;
about 2.75 percent, by weight, palladium;
about 1.0 percent, by weight, tin;
about 0.75 percent, by weight, zinc; and
completely melting said casting grains by heating said crucible to a temperature of at least about 1790 degrees F.;
pouring said molten alloy into an investment mold containing one or more jewelry article shaped cavities;
allowing said molten alloy to cool and solidify within said investment mold to form said one or more jewelry articles;
removing said investment mold from said solidified one or more jewelry articles;
and polishing said one or more jewelry articles.

22. A method of making one or more jewelry articles according to claim 21 wherein said alloy further comprises a grain refiner.

23. A method of making one or more jewelry articles according to claim 22 wherein said grain refiner comprises ruthenium.

24. A method of making one or more jewelry articles according to claim 23 wherein said ruthenium comprises about 0.005 percent, by weight, of said alloy.

25. A method of making one or more jewelry articles according to claim 21 wherein said jewelry article has an as cast hardness of at least about 95 on the Vickers scale.

26. A method of making one or more jewelry articles according to claim 21 wherein said jewelry article has an as cast hardness of between about 95 and about 120 on the Vickers scale.

27. A method of making one or more jewelry articles according to claim 26 wherein said one or more polished jewelry articles have a CIE LAB L* value of at least about 90 and wherein said one or more jewelry articles will maintain a CIE LAB L* value of at least about 90 after 96 hours exposure to an acetic acid solution containing ten percent sodium chloride and having a pH of 2.1.

28. A method of making one or more jewelry articles according to claim 21 wherein said one or more jewelry articles, as cast and prior to polishing, have a CIE LAB L* value of at least about 60.

29. A method of making one or more jewelry articles according to claim 21 further comprising age hardening said one or more jewelry articles.

30. A method of making jewelry articles according to claim 29 where said one or more jewelry articles have a hardness of about 160 on the Vickers scale, after age hardening.

* * * * *